US008282437B2

(12) United States Patent
Norman et al.

(10) Patent No.: US 8,282,437 B2
(45) Date of Patent: Oct. 9, 2012

(54) LAUNCHABLE DOLLS

(75) Inventors: Casey W. Norman, Andoversford (GB); David Gamlin, Bath (GB); Tony Thatcher, Somerset (GB)

(73) Assignee: Genie Toys plc (GB)

( * ) Notice: Subject to any disclaimer, the term of this patent is extended or adjusted under 35 U.S.C. 154(b) by 269 days.

(21) Appl. No.: 12/721,241

(22) Filed: Mar. 10, 2010

(65) Prior Publication Data

US 2010/0197191 A1 Aug. 5, 2010

Related U.S. Application Data

(63) Continuation-in-part of application No. 11/988,422, filed as application No. PCT/GB2006/002712 on Jul. 20, 2006, now abandoned.

(30) Foreign Application Priority Data

Jul. 22, 2005 (GB) ..... 0515118.8

(51) Int. Cl.
*A63H 27/127* (2006.01)

(52) U.S. Cl. ..... 446/37; 446/38; 446/39; 446/40; 446/41; 446/236; 446/309

(58) Field of Classification Search ..... 446/36–45, 446/57–60, 308, 309, 311, 312, 330, 331, 446/335, 429, 435–437
See application file for complete search history.

(56) References Cited

U.S. PATENT DOCUMENTS

| | | | | |
|---|---|---|---|---|
| 447,284 | A | 2/1891 | del Valle | |
| 4,125,961 | A | 11/1978 | Yamashina | |
| 4,148,450 | A | 4/1979 | Neuhierl | |
| 4,233,773 | A | 11/1980 | Jones | |
| 4,571,206 | A * | 2/1986 | Mayer et al. | 446/330 |
| 4,673,367 | A | 6/1987 | MacBain | |
| 5,334,073 | A | 8/1994 | Tilbor et al. | |
| 5,413,514 | A | 5/1995 | Milligan | |
| 5,525,086 | A | 6/1996 | Gentile et al. | |
| D372,277 | S | 7/1996 | Henley | |
| D377,058 | S | 12/1996 | Henley | |
| 6,221,409 | B1 | 4/2001 | BuenoCeresuela | |
| 6,247,990 | B1 | 6/2001 | Moorhouse | |
| 6,568,986 | B2 | 5/2003 | Kobayashi | |
| 6,773,329 | B2 | 8/2004 | Hornsby et al. | |
| 7,575,496 | B2 | 8/2009 | Lau et al. | |
| 2005/0191936 | A1 * | 9/2005 | Marine et al. | 446/376 |

FOREIGN PATENT DOCUMENTS

| | | | |
|---|---|---|---|
| CA | 2144900 | A1 | 3/1996 |
| EP | 0 985 351 | B1 | 3/2000 |
| GB | 498642 | A | 1/1939 |

* cited by examiner

*Primary Examiner* — Gene Kim
*Assistant Examiner* — Joseph B Baldori
(74) *Attorney, Agent, or Firm* — DLA Piper LLP (US)

(57) ABSTRACT

A set includes a launchable doll having a body portion and wings fixed to the body portion between a torso portion and a waist portion of the body portion to impart aerodynamic lift to the doll when the doll is rotated and the legs are fixed into a substantially vertical orientation when the wings are fixed to the body portion; and a launcher including a base, a tube that contains the legs and a mechanism that rotates the tube and the doll with respect to the base.

5 Claims, 7 Drawing Sheets

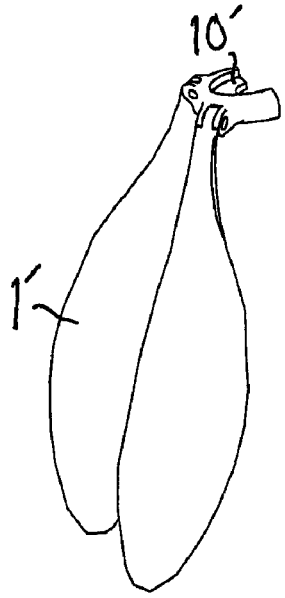
Fig. 6
Fig. 7
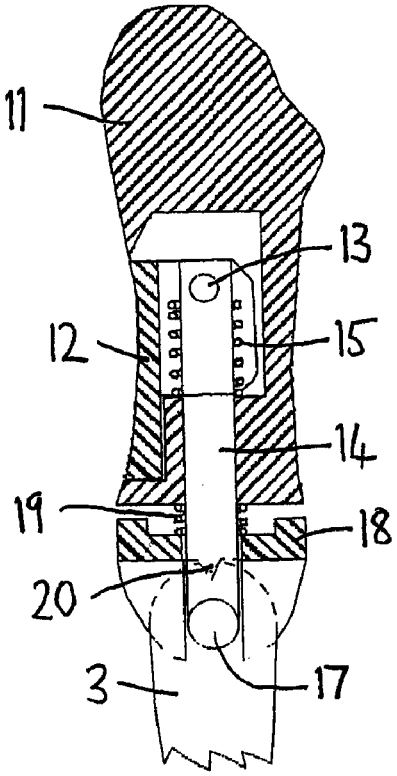
Fig. 8
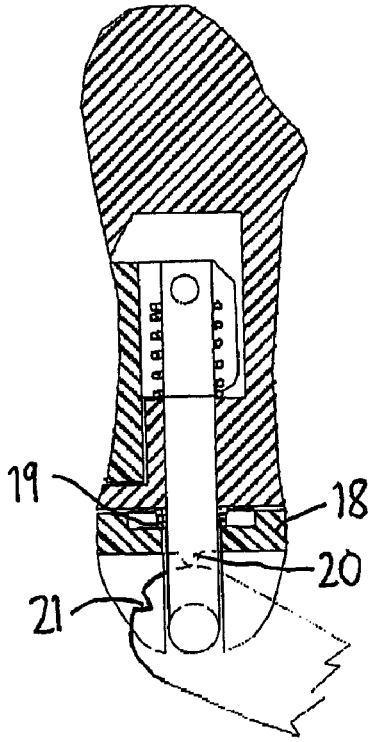

LAUNCHABLE DOLLS

RELATED APPLICATIONS

This is a continuation-in-part application of U.S. Ser. No. 11/988,422, filed Jan. 7, 2008, which is a §371 of International Application No. PCT/GB2006/002712, with an international filing date of Jul. 20, 2006 (WO 2007/010264 A2, published Jan. 25, 2007), which is based on British Patent Application No. 0515118.8, filed Jul. 22, 2005.

TECHNICAL FIELD

This disclosure relates to launchable dolls comprising wings which impart aerodynamic lift to a figurine when it is rotated.

BACKGROUND

U.S. Pat. No. 5,525,086 discloses a doll. However, it could be advantageous to provide a more versatile doll.

SUMMARY

We provide a launchable doll having arms, legs and wings, the wings fixed to the doll at a waist level thereof to impart aerodynamic lift to the doll when the doll is rotated.

We also provide a set including the launchable doll and a launcher including a base, a tube that accommodates the legs and a mechanism that rotates the tube and the doll with respect to the base.

We further provide a launchable doll having wings that are fixed to but detachable from the doll at the waist level thereof and which impart aerodynamic lift to the doll when the doll is rotated.

We still further provide a launchable doll having four wings provided on two parts that fit together around a body portion of the doll at a waist level thereof and which impart aerodynamic lift to the doll when the doll is rotated. The wings may be hinged.

BRIEF DESCRIPTION OF THE DRAWINGS

Representative dolls will now be described in more detail, by way of example only, and with reference to the accompanying drawings, in which:

FIG. 6 shows an alternative wing part;

FIGS. 7 to 12 are sectional views showing stages in the fitting of the wings;

DETAILED DESCRIPTION

We provide a launchable doll having wings which impart aerodynamic lift to the doll when it is rotated, the wings being fixed to the doll at a waist level thereof. This allows the doll to have movable limbs so that it can be posed and dressed as a regular doll—when the wings are removed. It also allows the doll to be launched from a launcher without having specific means for coupling to the launcher.

The wings may be pivotable with respect to the body of the doll so that, when not rotating, the wings fall to a substantially vertical position. This allows the doll to sit. The wings may thus provide a skirt for the doll.

The wings may be detachable from the doll as desired. In particular, the wings may be attachable between a torso portion and a waist portion of the body portion. The hinged wing assembly may clip between the upper and lower body halves. The body may clip back together fully with no gap when the wings are not there. The torso and waist portions may be slidable towards and away from each other and at least one spring may be provided to clamp a projection on the wings between the torso and waist portions. At least one leg of the doll may be pivotably attached at least indirectly to the torso portion and provided with cam means for moving the leg or waist portion towards the torso portion. A lever may be provided on the torso portion to urge the waist portion away from the torso portion to release the wings. The legs may be locked in a vertical position when the wings are locked in place.

A particular construction of the doll may have four wings. The wings may be provided on two parts which fit together around the body of the doll.

Preferably, the doll comprises articulated legs and/or arms.

We also provide a set comprising a launchable doll as defined above and a launcher comprising a base, a tube for containing the legs of the doll and a mechanism for rotating the tube and the doll with respect to the base. The wings of the doll may be arranged to rest on an upper end of the tube. The mechanism may be a windable clockwork mechanism or may be powered by a pull string or a pullable serrated strip. The mechanism may also be battery operated with a release when a desired rotational speed is reached.

Figure 1:
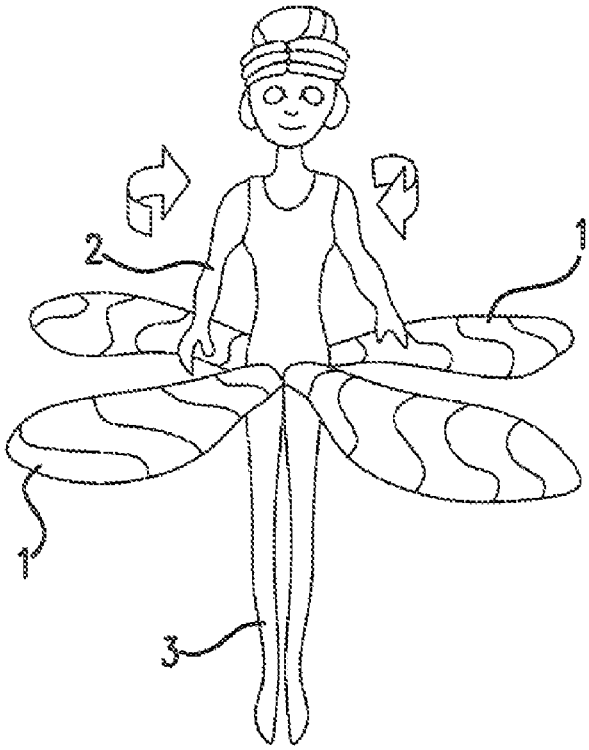
FIG. 1 shows a launchable doll.

Turning now to the drawings, FIG. 1 shows a doll having wings 1 which are arranged to impart aerodynamic lift to the doll when the doll is rotated as shown by the arrows. The wings are detachable from the body of the doll and the doll has articulated arms 2 and legs 3 allowing dressing, etc. when the wings 1 are removed.

Figure 2:
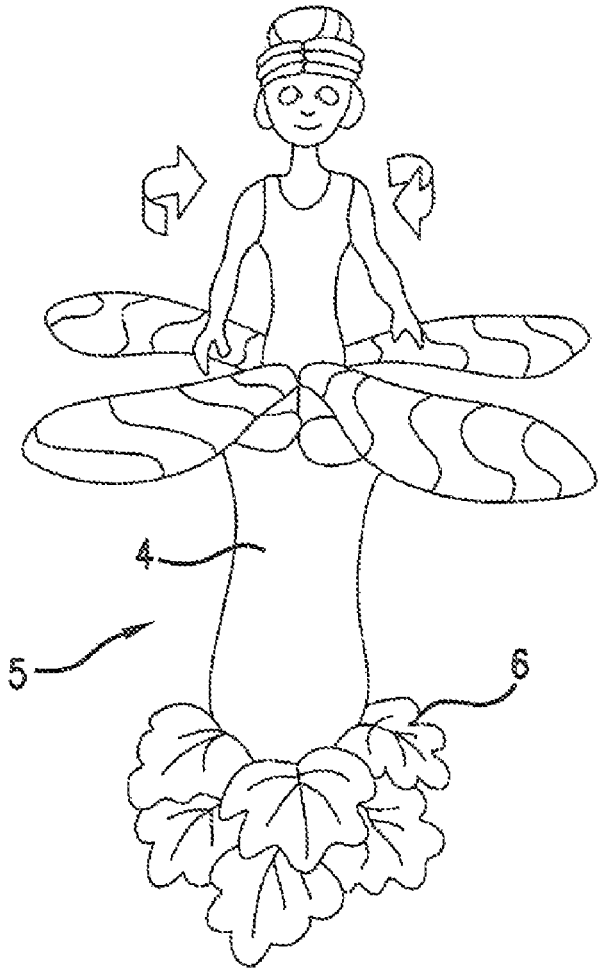
FIG. 2 shows the doll of FIG. 1 in a launcher.
Figure 17:
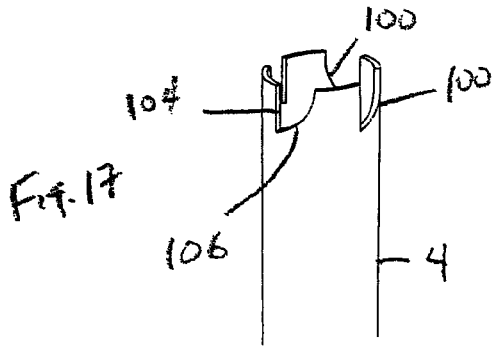
FIG. 17 is a perspective view of a doll launching tube.
Figure 18:
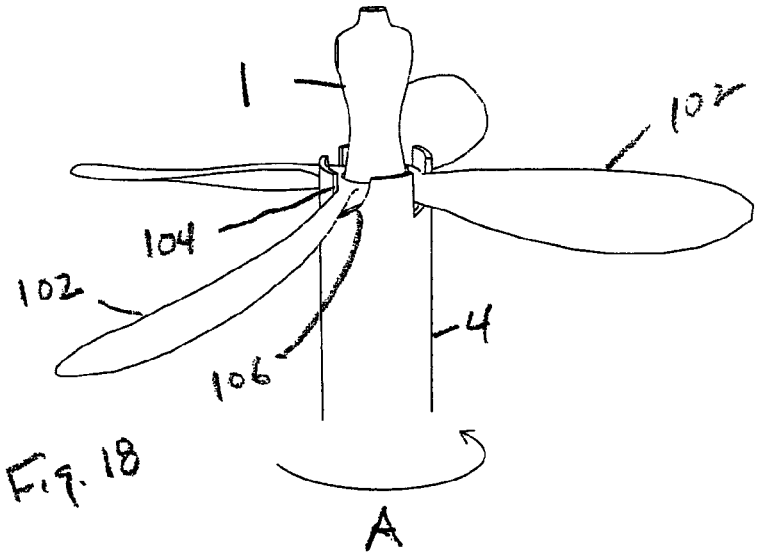
FIG. 18 is a perspective view of the launching tube found in FIG. 17 with a portion of a doll resting in the tube.
Figure 19:
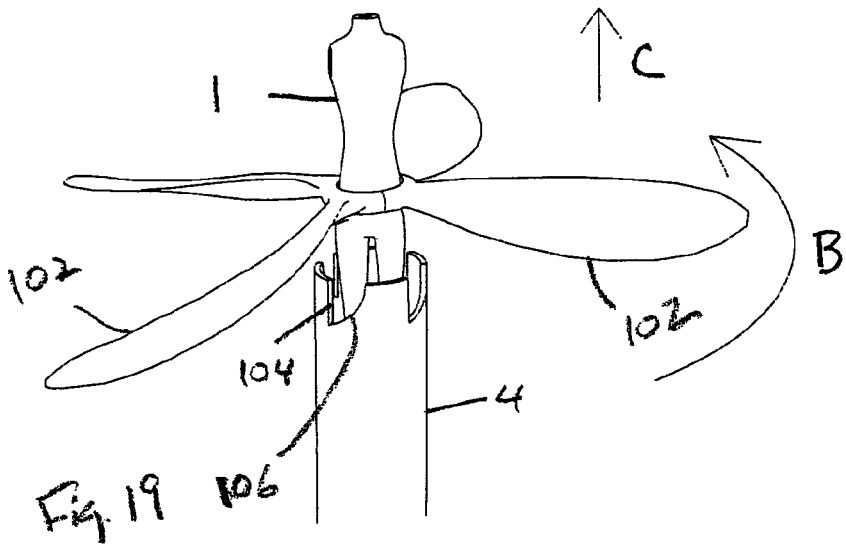
FIG. 19 is a perspective view of the launching tube of FIG. 17 and the doll of FIG. 18 wherein the doll has just been "launched" by rotation of the tube.

FIG. 2 shows how the legs of the doll are inserted in a tube 4 of a launcher 5. The tube is rotatable with respect to a base 6 of the launcher. The tube is rotated, for example, by a geared mechanism powered by a windable spring. FIGS. 17-19 show one form of a tube 4 and the mechanism in which a doll having wings 1 is launched.

Referring first to FIG. 17, tube 4 has a plurality of grooves 100 cut into the sidewall of tube 4. As shown in FIG. 18, those grooves are sized and shaped to engage the proximal end of wings 102. Each groove has a vertically oriented catch portion 104 and a curved portion 106. The catch portion 104 is intended to maintain the doll in a relative constant position with respect to tube 4 during rotation of tube 4 such as by rotation indicated by the arrow A in FIG. 18.

In FIG. 19, rotation of tube 4 has stopped and, at that point, the proximal portion of wings 102 is free, by momentum, to travel along the curved portion 106 of the launch tube, thereby causing the doll 1 to continue rotating as shown by arrow B in FIG. 19 and also to travel upwardly (preferably vertically) as indicated by arrow C in FIG. 19.

When the doll 1 is clear of the tube 4, spinning action continues and the doll 1 continues to rise due to the aerodynamic lift generated by the distal ends of wings 102.

The mechanism described above is easier to use than the pull cord mechanism of U.S. Pat. No. 5,525,086 and enhances safety as it allows the amount of rotation and, hence, the lift to be closely controlled. An alternative mechanism is powered by a so-called "rip cord" which is a serrated strip, usually of plastics such as poly-propylene. This strip is loaded into the launcher and engages teeth, either on the launching tube or on a gear at least indirectly connected to the tube to cause the required rotation when pulled through.

Figure 3:
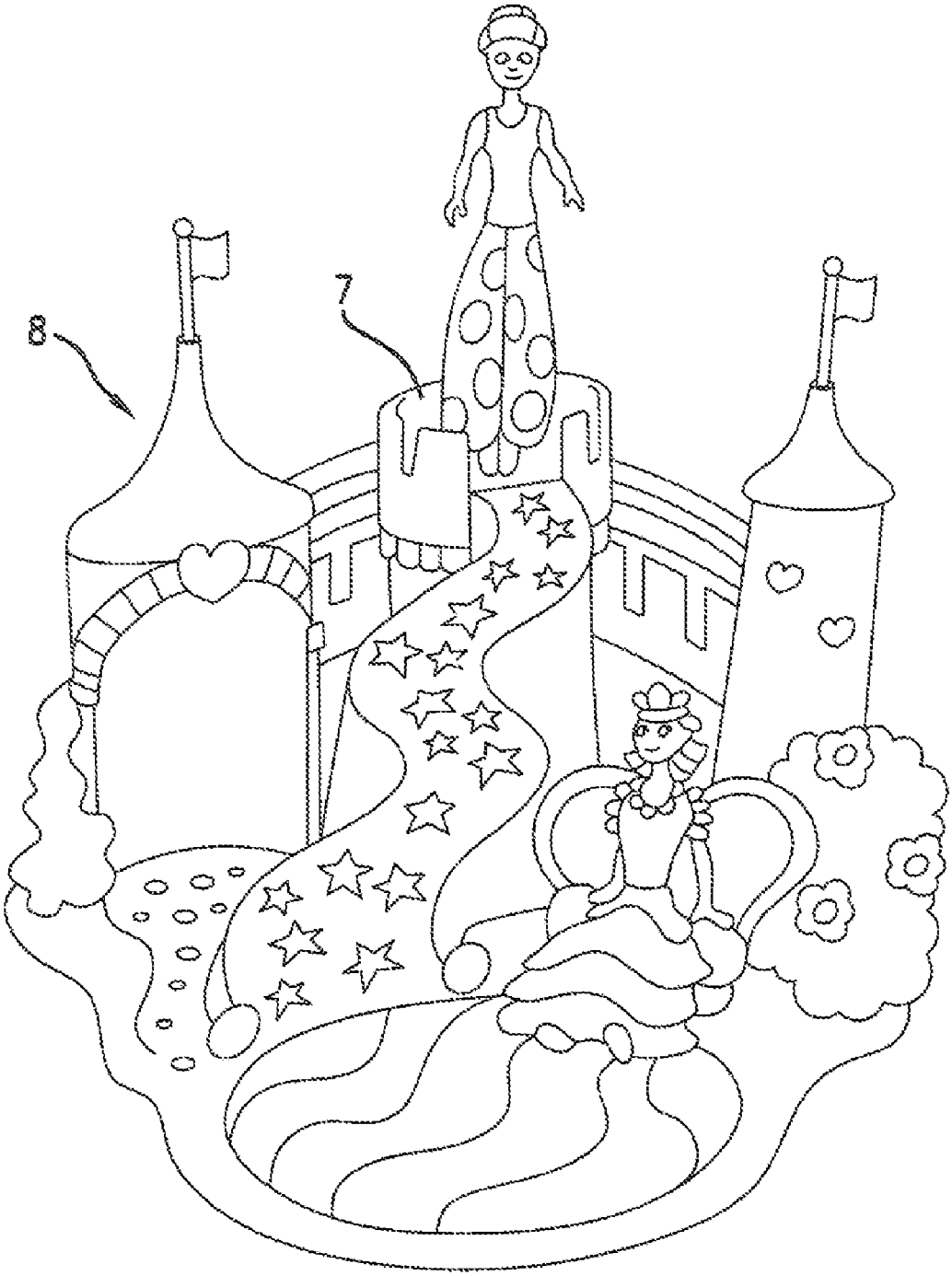
FIG. 3 shows an alternative launcher.

FIG. 3 shows an alternative launcher in which a rotatable tube is formed inside a tower 7 of a palace 8.

Figure 4:
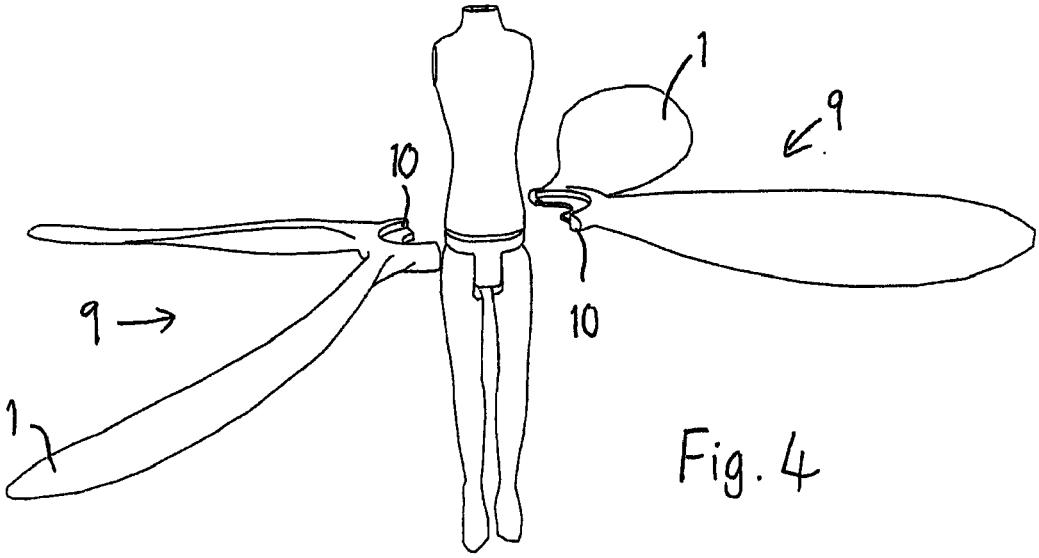
FIGS. 4 and 5 show the wing parts of the doll in more detail.
Figure 5:
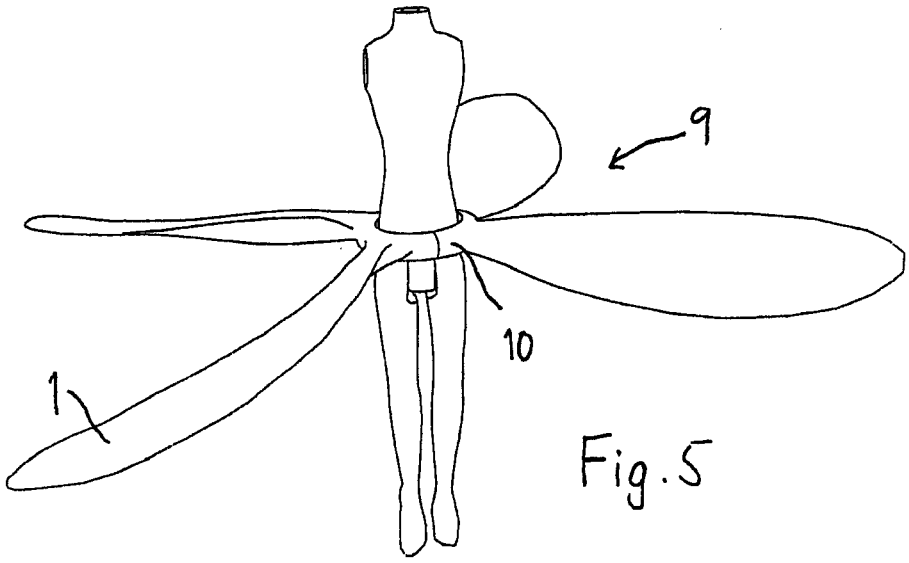

FIGS. 4 and 5 show one way in which the wings 1 may be fitted to the doll. Two wings 1 are formed on each of two wing parts 9, each wing part having a semicircular portion 10. The semicircular portions 10 are joined to form a ring extending around the body of the doll.

FIG. 6 shows an alternative wing part in which wings 1' are pivotable downwardly relative to a semicircular portion 10'. The wings 1' can form a skirt for the doll in this position. When the doll is rotated the wings 1' rise to a horizontal position by their aerodynamic lift.

FIG. 7 is a sectional view of one structure of the body of the doll. A torso 11 has a rear lever 12 which is pivoted at 13 to a rod 14 arranged to slide vertically within the torso. An upper spring 15 biases the rod 14 upwardly. The leg 3 of the doll is pivoted at 17 to the lower end of the rod 14. A waist portion 18 is retained between the leg 3 and the torso 11 and is biased downwardly by a lower spring 19 arranged around the rod 14. A projection 20 on the waist portion 18 engages a recess 21 in the leg 3 when the latter is in line with the axis of the torso 11.

As shown in FIG. 8, when the leg 3 is bent, the projection 20 is disengaged from the recess 21, forcing the waist portion 18 upwardly and compressing the lower spring 19.

Figure 9:
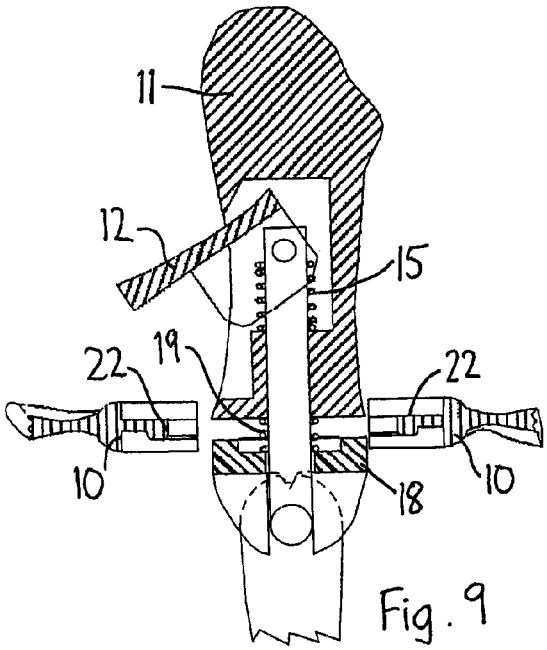

FIG. 9 shows that when the lever 12 is lifted, the lower spring 19 expands and the upper spring 15 is compressed until the two forces balance. At that point, the gap between the torso 11 and the waist portion 18 is large enough to receive a protrusion 22 on the semicircular portion 10 of the wing part 9, the waist portion 18 being shaped to receive this protrusion.

Figure 10:
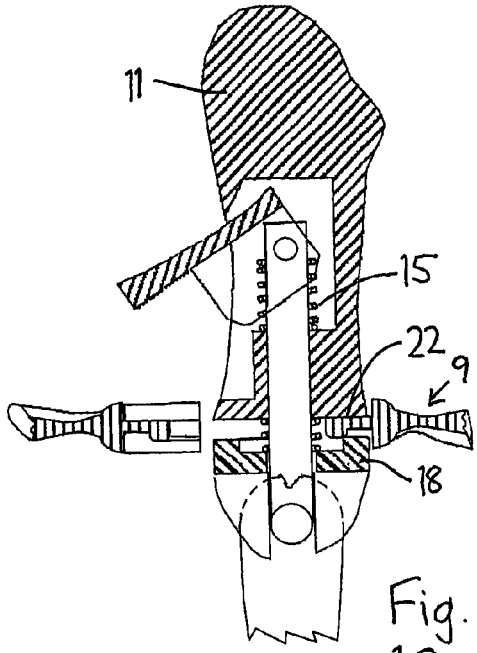

As shown in FIG. 10, the wing part 9 is pushed further into the gap, pushing the torso 11 and the waist portion 18 further apart and compressing the upper spring 15 further. When the protrusion 22 is fully home it snaps into its location in the waist portion 18 as the upper spring 15 is released.

Figure 11:
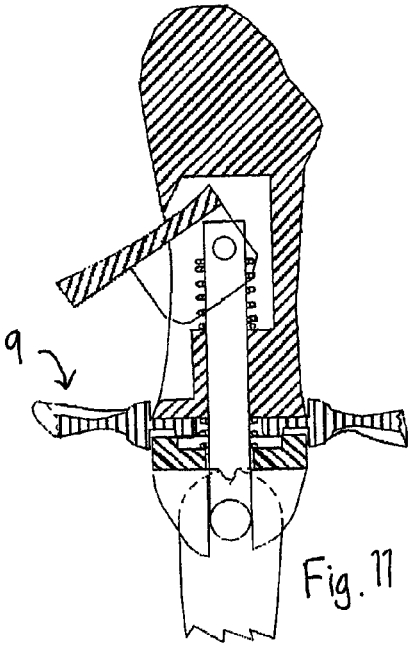

The wing part 9 is held loosely between the torso 11 and the waist portion 18 and the second wing part 9 is inserted as shown in FIG. 11.

Figure 12:
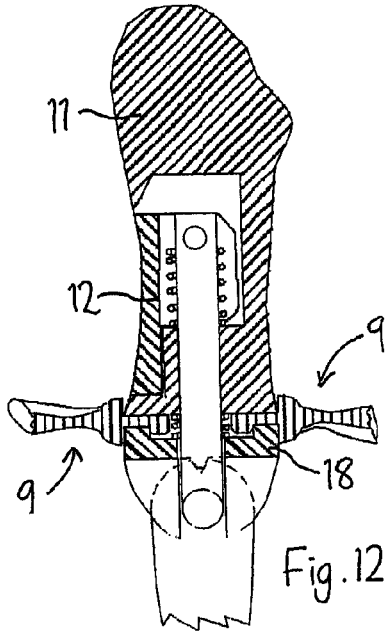

FIG. 12 shows that when the lever 12 is pushed down, the wing parts 9 are clamped securely between the torso 11 and the waist portion 18.

Figure 13:
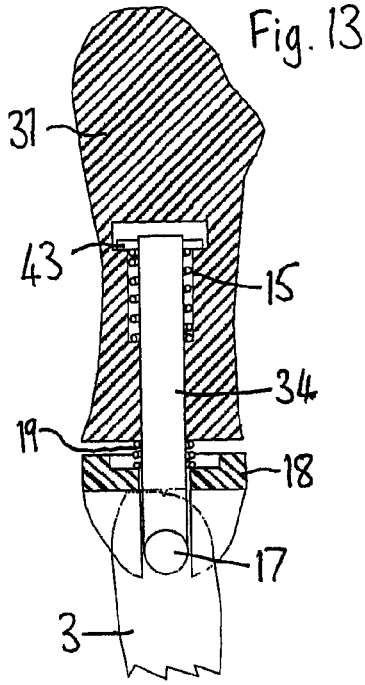
FIGS. 13 to 16 are sectional views showing stages in the fitting of other wings.

FIG. 13 shows an alternative structure in which the doll's legs are used to lock the wing parts in place. A rod 34 is arranged to slide vertically in a torso 31. The upper end of the rod is retained by a pin 43. The attachment of the leg 3 and the waist portion 18 is similar to the previous structure.

Figure 14:
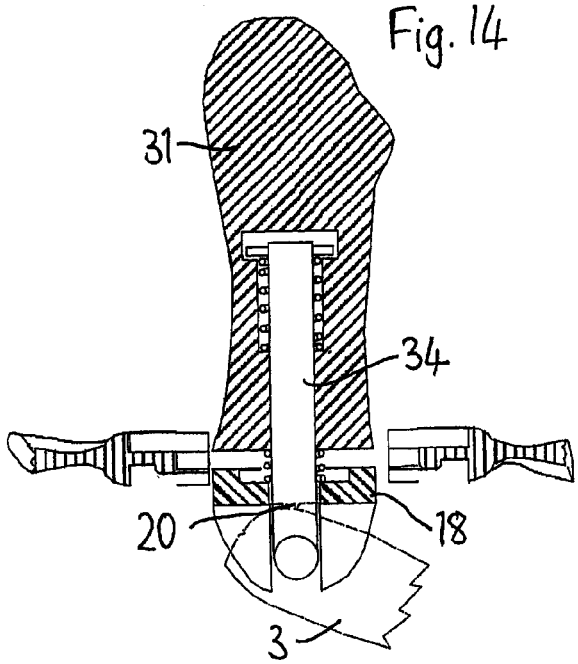

As shown in FIG. 14, when the leg 3 is bent, the projection 20 on the waist portion 18 pulls the rod 34, and thus the leg 3, upwardly towards the torso 31. The gap between the torso 31 and the waist portion 18 is maintained because the lower spring 19 is stronger than the upper spring 15.

Figure 15:
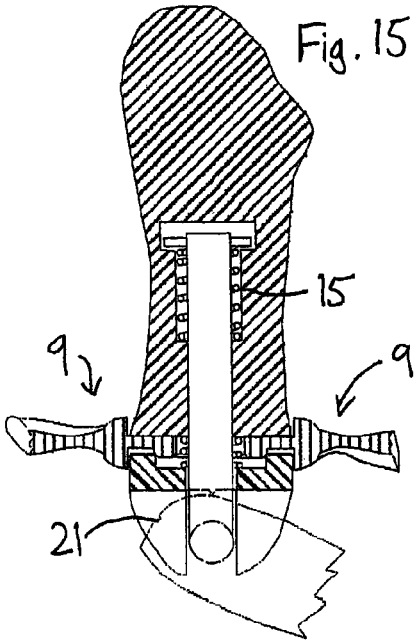

The wing parts 9 are pushed into place as shown in FIG. 15 and snap into position under the force of the upper spring 15.

Figure 16:
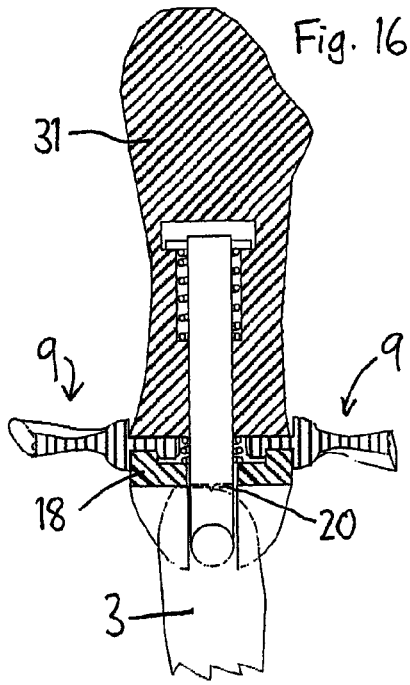

As shown in FIG. 16, as the legs 3 of the doll are straightened the cam surface thereof moves the waist portion 18 upwards and clamps the wing parts 9 in place. At the end of the travel projection 20 engages in recess 21, locking leg 3 in place.

The wings of the doll may be covered with flexible plastics material that is softer than the remainder of the doll to allow easier catching and improved safety. The doll may have conventional fabric wings attached to its torso to allow it to resemble a fairy. The doll may include a light source, such as one or more light emitting diodes, which may be used to transfer light to transparent or tinted wings, providing an interesting effect when the wings rotate.

The word "doll" as used herein embraces both male and female human figures as well as animal, cartoon and fantasy figures.

The invention claimed is:

1. A set comprising:

a launchable doll having a body portion and wings fixed to the body portion between a torso portion and a waist portion of the body portion to impart aerodynamic lift to the doll when the doll is rotated and the legs are fixed into a substantially vertical orientation when the wings are fixed to the body portion; and a launcher comprising a base, a tube that contains the legs and a mechanism that rotates the tube and the doll with respect to the base; wherein the tube comprises at least one notch sized and shaped to receive at least a portion of a proximal portion of at least one of the wings, the notch having one portion that engages the wing and causes the wing to rotate in concert with rotation of the tube and a curved portion which allows the wing to simultaneously continue rotating upon cessation of rotation of the tube and move vertically out of the notch and thereby launch the doll.

2. The set according to claim 1, wherein the wings of the doll are arranged to rest on an upper end of the tube.

3. The set according to claim 1, wherein the mechanism is a windable clockwork mechanism.

4. The set according to claim 1, wherein the mechanism is powered by a pull string or a pullable serrated strip.

5. A set comprising:

a launchable doll having a body portion, articulated arms, articulated legs and wings, the wings fixed to the body portion between a torso portion and a waist portion of the body portion to impart aerodynamic lift to the doll when the doll is rotated and the legs are fixed into a substantially vertical orientation when the wings are fixed to the body portion; and a launcher comprising a base, a tube that contains the legs and a mechanism that rotates the tube and the doll with respect to the base; wherein the tube comprises at least one notch sized and shaped to receive at least a portion of a proximal portion of at least one of the wings, the notch having one portion that engages the wing and causes the wing to rotate in concert with rotation of the tube and a curved portion which allows the wing to simultaneously continue rotating upon cessation of rotation of the tube and move vertically out of the notch and thereby launch the doll.

* * * * *